US011657657B2

(12) United States Patent
Nishiyama et al.

(10) Patent No.: US 11,657,657 B2
(45) Date of Patent: May 23, 2023

(54) IMAGE DATA DISTRIBUTION SYSTEM AND IMAGE DATA DISPLAY TERMINAL

(71) Applicant: Toyota Jidosha Kabushiki Kaisha, Toyota (JP)

(72) Inventors: Masahiro Nishiyama, Toyota (JP); Kenji Tsukagishi, Toyota (JP); Takahisa Kaneko, Toyota (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 265 days.

(21) Appl. No.: 17/005,797

(22) Filed: Aug. 28, 2020

(65) Prior Publication Data

US 2021/0158632 A1 May 27, 2021

(30) Foreign Application Priority Data

Nov. 22, 2019 (JP) ..... JP2019-211215

(51) Int. Cl.

| | |
|---|---|
| ***G07C 5/00*** | (2006.01) |
| ***G08G 1/0967*** | (2006.01) |
| ***G08G 1/01*** | (2006.01) |
| ***G08G 1/16*** | (2006.01) |

(52) U.S. Cl.

CPC ..... *G07C 5/008* (2013.01); *G08G 1/0112* (2013.01); *G08G 1/096775* (2013.01); *G08G 1/163* (2013.01)

(58) Field of Classification Search

CPC ..... G07C 5/008; G08G 1/0112; G08G 1/096775; G08G 1/163

USPC ..... 701/1

See application file for complete search history.

(56) References Cited

U.S. PATENT DOCUMENTS

| | | | | |
|---|---|---|---|---|
| 9,141,995 | B1 * | 9/2015 | Brinkmann | G07C 5/02 |
| 9,870,716 | B1 * | 1/2018 | Rao | G06T 19/006 |
| 10,031,526 | B1 * | 7/2018 | Li | G01S 19/03 |
| 10,037,689 | B2 * | 7/2018 | Taylor | G05D 1/0285 |
| 2002/0029242 | A1 * | 3/2002 | Seto | H04L 67/34 709/246 |
| 2004/0125126 | A1 * | 7/2004 | Egawa | H04N 21/44222 348/E7.071 |
| 2005/0088544 | A1 * | 4/2005 | Wang | H04H 60/27 348/E5.051 |

(Continued)

FOREIGN PATENT DOCUMENTS

| | | | |
|---|---|---|---|
| JP | 2003-274382 | A | 9/2003 |
| JP | 2006-236292 | A | 9/2006 |

(Continued)

*Primary Examiner* — Kerri L McNally
*Assistant Examiner* — Thang D Tran
(74) *Attorney, Agent, or Firm* — Dinsmore & Shohl LLP

(57) ABSTRACT

A distribution system includes a collection server, a storage server, and a distribution server. The collection server acquires image data captured by an on-vehicle camera, creates a table in which imaging position information is associated with imaging environment information, and stores the table in the storage server. The distribution server accepts a distribution request in which an imaging position condition and an imaging environment condition are designated. The distribution server searches the image data satisfying the imaging position condition and the imaging environment condition, and performs distribution.

5 Claims, 7 Drawing Sheets

(56) References Cited

U.S. PATENT DOCUMENTS

2005/0219375 A1* 10/2005 Hasegawa ..... G08G 1/0175 348/208.14
2005/0257273 A1* 11/2005 Naito ..... G06T 1/60 726/26
2006/0248569 A1* 11/2006 Lienhart ..... H04N 5/76 725/135
2007/0276589 A1* 11/2007 Inoue ..... G01C 21/3647 701/426
2010/0088021 A1* 4/2010 Viner ..... G06Q 30/02 709/201
2012/0215446 A1* 8/2012 Schunder ..... H04L 67/125 702/3
2015/0046087 A1* 2/2015 Nogawa ..... G08G 1/012 701/522
2016/0123743 A1* 5/2016 Sisbot ..... G01C 21/3461 701/538
2017/0212912 A1* 7/2017 Chun ..... H04L 67/12
2017/0300503 A1* 10/2017 Wang ..... G06F 16/71
2018/0032997 A1* 2/2018 Gordon ..... G06Q 30/0269
2018/0052658 A1* 2/2018 Adachi ..... G01C 21/3608
2018/0350144 A1* 12/2018 Rathod ..... G06Q 20/3224
2019/0213425 A1* 7/2019 Anderson ..... G08G 1/0112
2019/0306677 A1* 10/2019 Basu ..... G08G 1/0112
2020/0064142 A1* 2/2020 Choi ..... G01C 21/3407
2020/0088527 A1* 3/2020 Koda ..... G01C 21/3811
2020/0114930 A1* 4/2020 Syafril ..... G07C 5/008
2020/0160722 A1* 5/2020 Brugman ..... G08G 1/22
2020/0193643 A1* 6/2020 Hess ..... G01S 5/0284
2020/0249670 A1* 8/2020 Takemura ..... G08G 1/0141
2020/0255020 A1* 8/2020 Simmons ..... B60W 40/068
2021/0097311 A1* 4/2021 McBeth ..... H04W 4/80
2021/0174101 A1* 6/2021 Nishiyama ..... G06V 10/40
2021/0312564 A1* 10/2021 Katata ..... G06Q 40/08
2021/0370968 A1* 12/2021 Xiao ..... G06T 17/05
2022/0060928 A1* 2/2022 Jung ..... G08G 1/056

FOREIGN PATENT DOCUMENTS

JP 2008165033 A 7/2008
JP 2011141762 A 7/2011
JP 2014-164316 A 9/2014
JP 2015161592 A 9/2015
JP 2017-204104 A 11/2017
JP 2018133055 A 8/2018
JP 2019-021187 A 2/2019

* cited by examiner

FIG. 5

| DATA NUMBER | ROUTE AND TIME | YEAR/MONTH/DAY | DAY OF WEEK | TIME ZONE | WEATHER |
|---|---|---|---|---|---|
| 5026 | ····-A(10:03)-B(10:16)-C(10:21)-··· | 11/25/2019 | MONDAY | 9 TO 12 O' CLOCK | CLEAR |
| 5030 | ····-A(10:05)-B(10:19)-D(10:42)-E(11:17) | 11/25/2019 | MONDAY | 9 TO 12 O' CLOCK | CLEAR |
| 5088 | ····-G(10:08)-D(10:24)-B(10:44)-C(10:50)-··· | 11/25/2019 | MONDAY | 9 TO 12 O' CLOCK | CLEAR |
| 5124 | ····-C(10:09)-B(10:14)-D(10:38)-E(11:11)-F(11:55)-··· | 11/25/2019 | MONDAY | 9 TO 12 O' CLOCK | CLEAR |
| | | | | | |

IMAGE DATA DISTRIBUTION SYSTEM AND IMAGE DATA DISPLAY TERMINAL

CROSS-REFERENCE TO RELATED APPLICATIONS

This application claims priority to Japanese Patent Application No. 2019-211215 filed on Nov. 22, 2019, which is incorporated herein by reference in its entirety. including the specification, drawings and abstract.

BACKGROUND

1. Technical Field

The present disclosure relates to an image data distribution system and an image data display terminal according to an on-vehicle camera.

2. Description of Related Art

A vehicle may be equipped with an on-vehicle camera that captures an outside or an inside of the vehicle.

Japanese Unexamined Patent Application Publication No. 2014-164316 (JP 2014-164316 A) discloses that a user transmits image data of a desired on-vehicle camera of the vehicle that travels around a desired position to a user terminal and the user can be informed of a current state of the position in detail.

Japanese Unexamined Patent Application Publication No. 2006-236292 (JP 2006-236292 A) discloses that image data captured by an on-vehicle camera before and after the occurrence of an accident is recorded and transmitted to an insurance entrusted company.

SUMMARY

In Japanese Unexamined Patent Application Publication No. 2014-164316 (JP 2014-164316 A), the image data of the on-vehicle camera is merely provided to grasp the current state at a specific location.

In Japanese Unexamined Patent Application Publication No. 2006-236292 (JP 2006-236292 A), the image data of the on-vehicle camera about a specific situation, such as an accident, is merely transmitted to parties of the insurance entrusted company.

The on-vehicle camera captures the image data at various positions and in various environments. The convenience or satisfaction of the user is conceivable to be improved by providing the image data according to the condition requested by the user.

The present disclosure establishes a technique for providing image data of an on-vehicle camera captured at a position and in an environment desired by the user to the user.

A first aspect of the present disclosure relates to an image data distribution system including a storage unit, an accepting unit, and a distribution unit. The storage unit is configured to store image data captured by an on-vehicle camera in association with imaging position information and imaging environment information. The accepting unit is configured to accept a distribution request in which an imaging position condition and an imaging environment condition are designated. The distribution unit is configured to distribute the image data associated with the imaging position information satisfying the imaging position condition and the imaging environment information satisfying the imaging environment condition.

In the first aspect of the present disclosure, the imaging environment condition may be a condition relating to a timing at which imaging is performed.

In the first aspect of the present disclosure, the imaging environment information may be information on an event occurring around a vehicle equipped with the on-vehicle camera, and the imaging environment condition may be a condition for designating the event.

In the first aspect of the present disclosure, the imaging environment condition may be a weather condition under which imaging is performed.

In the first aspect of the present disclosure, the image data distribution system may further include an editing unit configured to perform editing for time reduction or time extension on the image data, and the distribution unit may be configured to distribute the edited image data.

In the first aspect of the present disclosure, the image data distribution system may further include a receiving unit set to be communicable with a plurality of vehicles and configured to receive the image data captured by the on-vehicle camera of each vehicle, and the storage unit may be configured to store the image data received by the receiving unit.

A second aspect of the present disclosure relates to an image data display terminal including a designating unit, a receiving unit, and a display unit. The designating unit is configured to designate imaging position condition and imaging environment condition. The receiving unit is configured to receive image data captured by an on-vehicle camera and associated with imaging position information satisfying the imaging position condition and imaging environment information satisfying the imaging environment condition. The display unit is configured to display the received image data.

According to the aspects of the present disclosure, image data of an on-vehicle camera can be recognized by designating a position and an imaging environment by a user. Therefore, a plurality of the image data captured at the same position can be selected depending on the imaging environment, and the convenience or satisfaction of the user can be expected to be improved.

BRIEF DESCRIPTION OF THE DRAWINGS

Features, advantages, and technical and industrial significance of exemplary embodiments of the present disclosure will be described below with reference to the accompanying drawings, in which like numerals denote like elements, and wherein:

FIG. 5 is a diagram showing an example of a table created based on the collected image data;

DETAILED DESCRIPTION OF EMBODIMENTS

Hereinafter, an embodiment will be described with reference to drawings. In the description, specific aspects are shown for easy understanding, but the specific aspects are merely example of the embodiment, and various other embodiments can be adopted.

Figure 1:
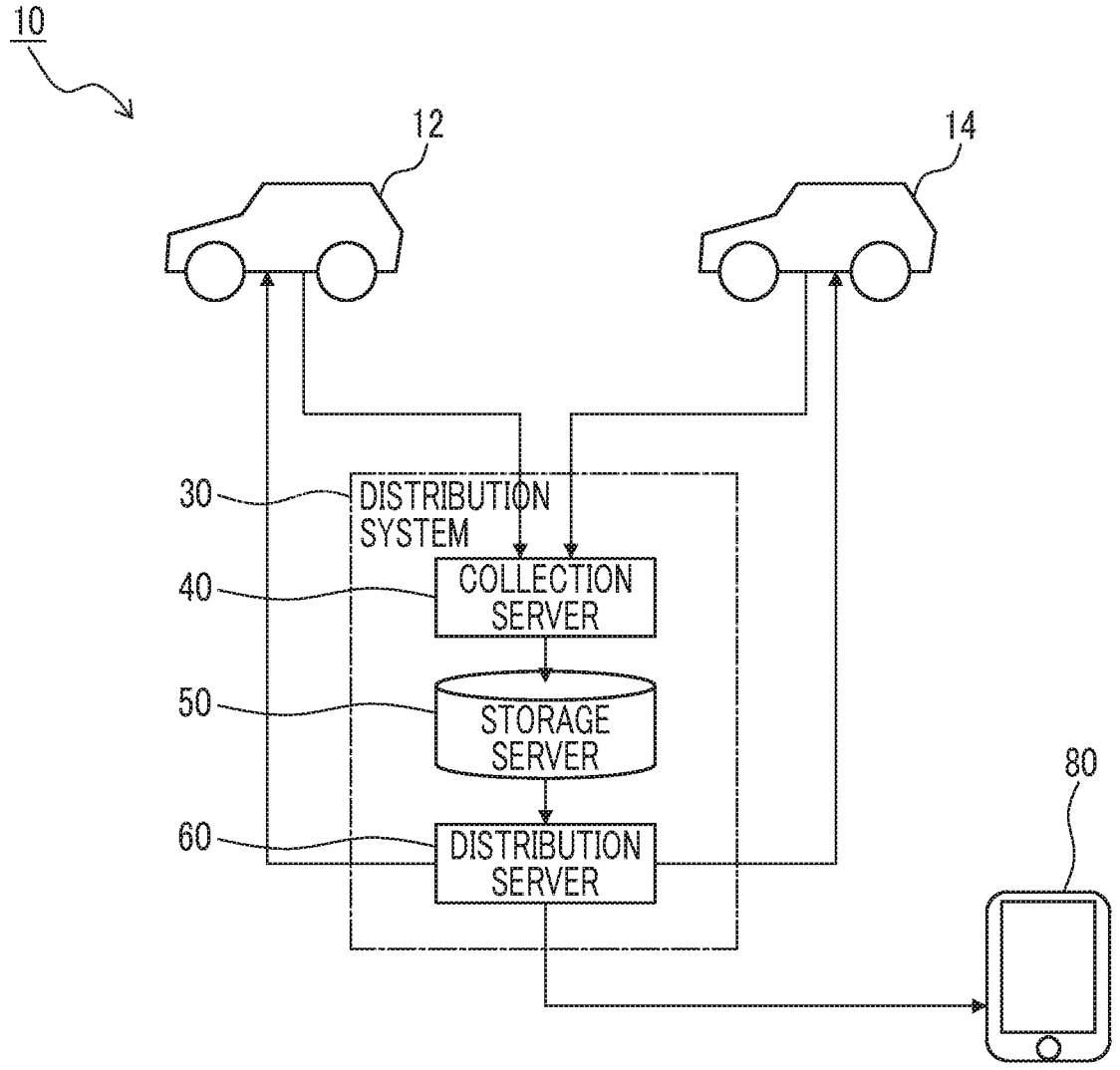
FIG. 1 is a diagram showing a configuration of an on-vehicle camera image utilization system according to an embodiment.

FIG. 1 is a diagram showing a schematic configuration of an on-vehicle camera image utilization system 10 according to an embodiment. The on-vehicle camera image utilization system 10 is a system that can execute a series of processing of collecting image data captured by an on-vehicle camera, distributing the image data to a user who wants the image data, and displaying the image data on a terminal of the user. The on-vehicle camera image utilization system 10 includes vehicles 12, 14, a distribution system 30, and a smartphone 80.

Two vehicles 12, 14 in FIG. 1 are shown as representatives of a number of vehicles including the on-vehicle camera. In general, in an area in which people act, a number of vehicles 12, 14 travel, and the image data of an outside of the vehicle is captured by the on-vehicle camera at various positions and in various environments. The image data captured by the vehicle 12, 14 are transmitted to the distribution system 30. The vehicles 12, 14 can receive the image data from the distribution system 30 and display the image data on a display.

The distribution system 30 is an example of an image data distribution system, and is a system built in distribution company offices. The distribution system 30 can be built using a plurality of hardware connected to a network. The distribution system 30 includes a collection server 40, a storage server 50, and a distribution server 60. The collection server 40 receives the image data from the vehicles 12, 14 that have obtained permission to participate in the on-vehicle camera image utilization system 10, and stores the image data in the storage server 50. The storage server 50 is a storage device that stores the image data. The distribution server 60 performs distribution of the image data according to a request of the user.

The smartphone 80 is an example of an image data display terminal, and a portable communication terminal used by the user. The smartphone 80 can accept distribution of the image data from the distribution system 30 and display the received image data in the display, by installing an application program on the smartphone 80.

Figure 2:
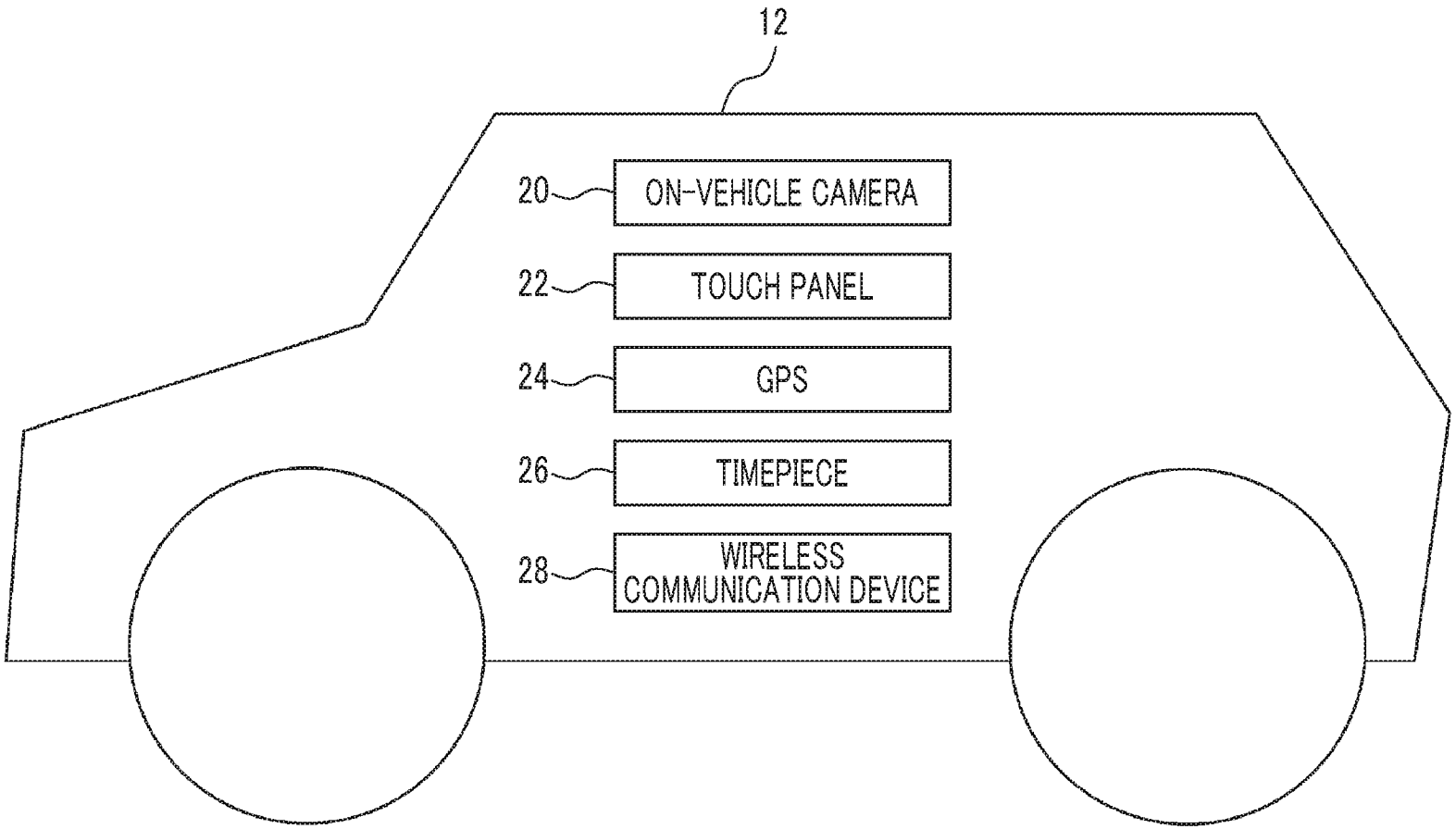
FIG. 2 is a diagram showing a configuration of a vehicle.

FIG. 2 is a diagram for describing the vehicle 12 shown in FIG. 1 in detail. The vehicle 12 includes an on-vehicle camera 20, a touch panel 22, a GPS 24, a timepiece 26, and a wireless communication device 28.

The on-vehicle camera 20 is a camera that is equipped on the vehicle 12 and captures a scene of the outside or the inside of the vehicle. The on-vehicle camera 20 is installed, for example, around a front end of a roof in a vehicle compartment, and captures the outside of the vehicle in front of the vehicle through the front windshield to acquire the image data. The image data is data that provides two-dimensional or three-dimensional visual information. The image data is generally a moving image, but may be a still image captured at suitable time intervals. The on-vehicle camera 20 can be used as, for example, a drive recorder that records a travel status of the vehicle 12. For example, in a case where the vehicle 12 includes an autonomous driving mode, the on-vehicle camera 20 can be used as a sensor that grasps a traffic status in front of the vehicle. In the on-vehicle camera image utilization system 10, the image data of the on-vehicle camera 20 is also used in a manner that the image data is transmitted to the distribution system 30 and is distributed to the third party from the distribution system 30. A visible light camera using visible light is normally used as the on-vehicle camera 20, but cameras with various wavelength bands, such as an infrared camera and an ultraviolet camera, can also be used. Also, the on-vehicle camera 20 may capture a side or a rear side of the vehicle 12 other than the front of the vehicle.

The touch panel 22 is a display by which a driver of the vehicle 12 can perform an input operation. The user, such as the driver, can call the car navigation system on the touch panel 22 and display guidance on a route to a destination. The touch panel 22 is an example of an image data display terminal. Also, the user can display the application program of the on-vehicle camera image utilization system 10 on the touch panel 22, request distribution of the image data, and display the image data distributed from the distribution system 30. The application program can be in conjunction with the car navigation system.

The GPS 24 is an abbreviation of a global positioning system and a sensor that detects a position of the vehicle 12 using a satellite. In the detection result of the GPS 24, the image data of the on-vehicle camera 20 of the vehicle 12 is used as imaging position data that specifies an imaging position. The travel route of the vehicle 12 can be recognized by reviewing the imaging position data chronologically.

The timepiece 26 is a device that displays a timing of date and time. In output of the timepiece 26, the image data of the on-vehicle camera 20 of the vehicle 12 is used as imaging time data that specifies an imaging timing.

The wireless communication device 28 is a device that communicates with the outside by wireless communication, such as Wi-Fi (registered trademark). The vehicle 12 transmits the captured image data, corresponding imaging position data, and corresponding imaging time data to the distribution system 30 through the wireless communication device 28. The vehicle receives various image data from the distribution system 30 through the wireless communication device 28.

The vehicle 12 may be further provided with a sensor that acquires data relating to a weather condition, such as a temperature sensor or an insolation sensor. The corresponding sensor output at the time of imaging may be transmitted together with the image data, as imaging weather condition data, to the distribution system 30 through the wireless communication device 28.

Figure 3:
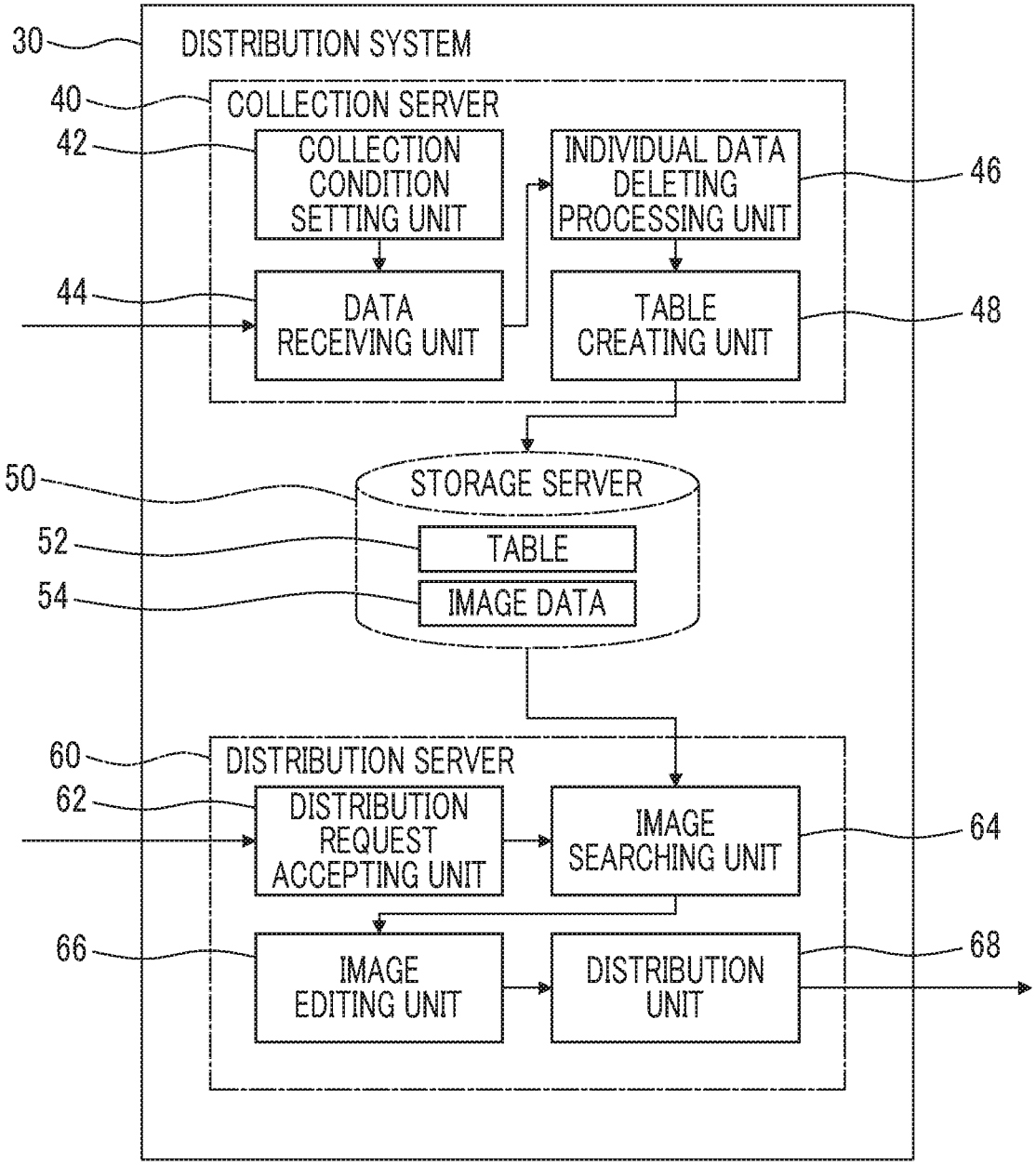
FIG. 3 is a diagram showing a configuration of a distribution system.

FIG. 3 is a block diagram for describing a function of the distribution system 30 in detail. The distribution system 30 includes the collection server 40, the storage server 50, and the distribution server 60. The collection server 40, the storage server 50, and the distribution server 60 are devices that is built by controlling a computer hardware including a memory, a processor, and the like by software such as an operating system (OS) or an application program.

In the collection server 40, a collection condition setting unit 42, a data receiving unit 44, an individual data deleting processing unit 46, and a table creating unit 48 are built under the control of the application program.

The collection condition setting unit 42 is to set a condition regarding a collection target of the image data of the on-vehicle camera 20. The collection condition may be set by a manager, or may be automatically set based on the program. Examples of the collection condition include designation of an area to be collected, designation of the vehicles 12, 14 to be collected in the area (the number of vehicles, a kind of vehicle, or a traveling speed), and designation of imaging time. The setting of the collection condition enables to positively collect image data in the area in which a small number of the vehicles 12, 14 travel, or at the time when a small number of the vehicles 12, 14 travel. The setting of the collection condition also enables to prevent the image data in the area in which a number of the vehicles 12, 14 travel, or at the time when a number of the vehicles 12, 14 travel from being collected more than needed.

The data receiving unit 44 is an example of a communication unit, and acquires the image data from the vehicles 12, 14, and corresponding imaging position data, imaging time data, and imaging weather condition data according to the collection condition set by the collection condition setting unit 42. Also, the data receiving unit 44 can acquire traveling speed data at the time of imaging, and vehicle kind data.

The individual data deleting processing unit 46 performs processing of deleting a part that is easy to specify an individual, such as a face of a person included in the image data or a license plate. The individual data deleting processing unit 46 discriminates a face of a person or a license plate according to the learning algorithm, such as deep learning, and performs processing of shading off the part.

The table creating unit 48 creates a table for searching the image data efficiently based on the imaging position data, the imaging time data, and the imaging weather condition data received with the image data. The table is created so as to include the imaging position information and the imaging environment information.

The imaging position information is information for specifying the position in which the image data is captured, and is basically arranged based on the received imaging position data. The imaging environment information is information relating to a timing or a weather condition under which the image data is captured. The timing at which the image data is captured is basically given by the imaging time data. In a case where the image data is captured around the event area during the event (for example, artificial events, such as holding festivals and sporting events in the area, and natural events, such as occurrence of earthquakes and cherry blossoms in the area), the event can be included as the imaging environment information relating to a timing. The imaging environment information relating to a weather condition is information on weather, the wind direction and the wind speed, and a temperature. The imaging environment information relating to a weather condition can be acquired based on the information provided from the meteorological agency. The imaging environment information relating to weather may be acquired using the imaging weather condition data acquired from the vehicle 12.

The storage server 50 is an example of a storage unit, and stores a table 52 created by the table creating unit 48 and image data 54. The storage server 50 can store the table 52 corresponding to the image data 54 captured in various periods and environments, within the country, in foreign countries, and around the world.

The distribution server 60 is an example of a distribution unit, and includes a distribution request accepting unit 62, an image searching unit 64, an image editing unit 66, and a distribution unit 68.

The distribution request accepting unit 62 is an example of an accepting unit, and accepts a distribution request for the image data from the touch panel 22 of the vehicles 12, 14 or the smartphone 80. In a case where the distribution request is made, the imaging position condition and the imaging environment condition may be designated.

The imaging position condition is a condition corresponding to the imaging position information, and is to designate the imaging position. For example, the condition that designates a start position, an end position, and a route between the start position and the end position is included in the imaging position condition. The imaging position condition may be a condition that broadly designate the imaging position. Examples of the broad designation include designating solely the start position and the end position, designating the travel road and one point included in the road, designating the start position and a travel direction, and designating a name of the area (for example, a city name, a tourist spot name, and a park name). Also, broad designation may be designating a name of the specific location (for example, stations, public facilities, buildings). In this case, a periphery of the location corresponding to the name or an area in which the location corresponding to the name is seen can be set as the imaging position condition. Characteristics of a plurality of positions may be designated as the imaging position condition. For example, roads along the coast, sights of autumn leaves, and cities of World Heritage are examples of designating a plurality of positions. In this case, for example, an aspect in which the corresponding image data is sequentially displayed according to the set priority order can be considered.

The imaging environment condition is a condition corresponding to the imaging environment information, and is to designate a specific timing or weather condition under which imaging is performed. Examples of designating a specific timing include a year, a season, a month, a day, an hour, a day of the week, and an event (festival or occurrence of an earthquake) in which the imaging is performed. A weather condition includes information on the wind direction and the wind speed, a temperature, and a humidity in addition to weather such as clear, cloudy, rainy, foggy, and snowy. A weather condition also includes storms and tornadoes caused by typhoons.

In a case where the distribution request accepting unit 62 accepts a distribution request, the image searching unit 64 performs searching of the image data based on the imaging position condition and the imaging environment condition. That is, the image searching unit 64 searches the corresponding image data 54 from the table 52 of the storage server 50 using the imaging position condition and the imaging environment condition as a searching key. In a case where a plurality of image data 54 that satisfies the condition is present, the image data 54 may be presented to the user and selected by user, or may be selected according to the suitable algorithm. In a case where the image data 54 that satisfies the condition is not present, a plurality of image data 54 may be combined to satisfy the condition, or image data 54 that does not satisfy the condition but is close to the condition may be selected.

The image editing unit 66 is an example of an editing unit, and performs editing on the image data 54 to be distributed. Editing includes processing of performing time extension of reproduction, such as slow-motion reproduction. Editing includes processing of performing time reduction of reproduction, such as fast forward reproduction, continuous reproduction of still images with time intervals, omission of similar scenery. The image editing unit 66 also performs continuous reproduction processing in a case where a plurality of image data 54 is selected. The image editing unit 66 may automatically perform editing according to the setting, or may perform editing based on the instruction of the user.

The distribution unit 68 performs distribution of the image data. The distribution can be performed by various methods, such as a streaming method and a download method.

An example of collection of the image data will be described with reference to FIGS. 4 and 5.

Figure 4:
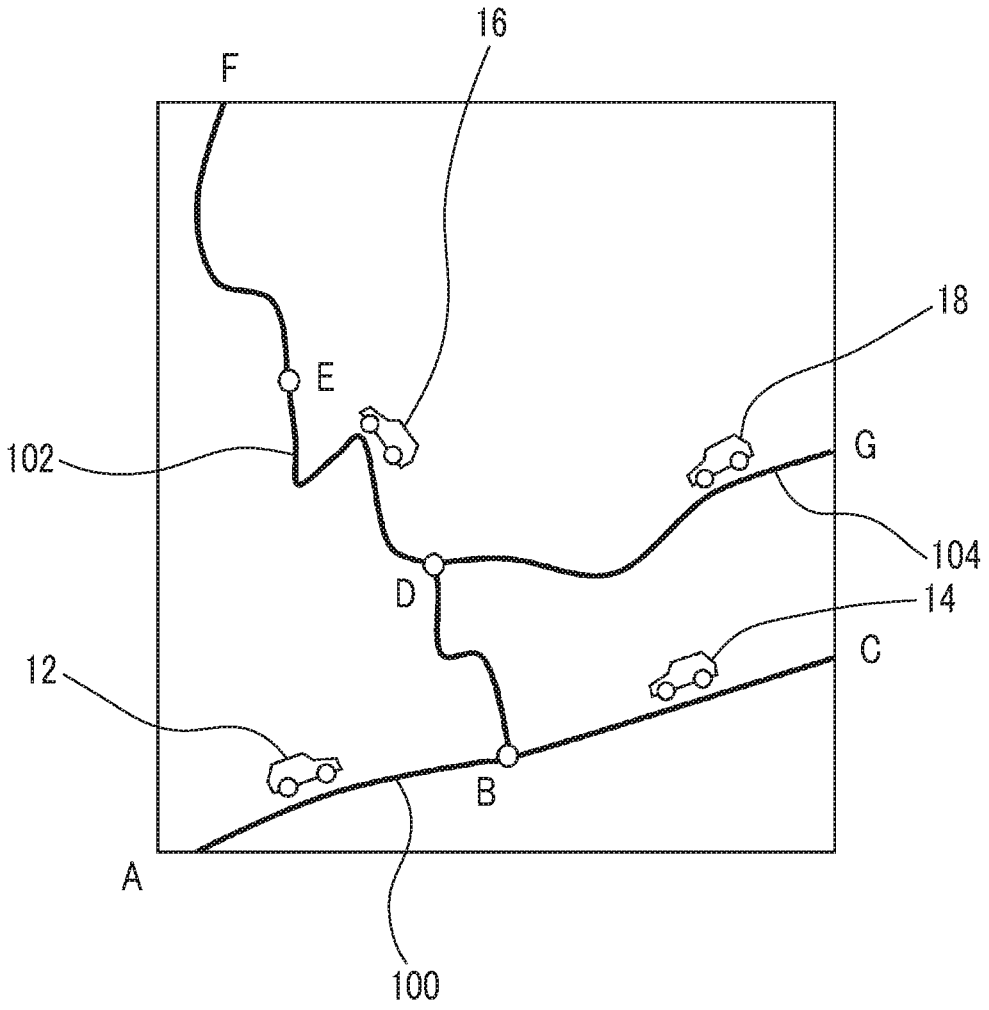
FIG. 4 is a diagram showing an example of a map on which the vehicle of an image data collection target travels.

FIG. 4 is a diagram showing a road map of a certain area. The map shows a road 100 connecting a position A and a position C that are present outside the map. A road 102 branches from a position B on the road 100. The road 102 passes through a position D and a position E to a position F outside the map. A different road 104 branches from the position D and is to a position G outside the map. In an example of FIG. 4, the vehicles 12, 14 travel on the road 100, a vehicle 16 travels on the road 102, and a vehicle 18 travels on the road 104.

In a case where the vehicles 12, 14, 16, 18 meet the collection condition set by the collection condition setting unit 42, the data receiving unit 44 receives the image data captured by the on-vehicle camera 20 of the vehicles 12, 14, 16, 18 together with the imaging position data and the imaging time data. After the image data is processed to delete individual data by the individual data deleting processing unit 46, and subjected to the table creation processing by the table creating unit 48.

FIG. 5 is a diagram showing an example of the table 52 created based on the image data collected by the vehicles 12, 14, 16, 18 that travel in the area shown in FIG. 4. In the example of the table 52 shown in FIG. 5, columns of "data number", "route and time", "year/month/day", "day of week", "time zone", and "weather" are provided.

The "data number" indicates a number given to the image data 54 stored in the storage server 50. The "route and time" is sequentially describes the time at which the vehicle travels at a position set on the map. The "year/month/day", the "day of week", and the "time zone" show the date, day of the week, and time zone in which the vehicle travels. The "weather" is an example of a weather condition, and shows weather information, such as clear and rainy.

In the example shown in FIG. 5, the image data captured by the vehicle 12 is stored as the data number "5026". The vehicle 12 passes the position A at time 10:03, passes the position B at time 10:16, and passes the position C at 10:21. The vehicle 12 passes on Monday, Nov. 25, 2019, a time zone from 9:00 to 12:00, and the weather is recorded as clear.

Similarly, the image data captured by the vehicle 16 is recorded as the data number "5030", and indicates that the vehicle 16 has arrived at the position E via the positions A, B, and D and has stopped. The data of the data number "5088" captured by the vehicle 18 includes a record in which the vehicle 18 travels at the position G, the position D, the position B, and the position C. Then, the data of the data number "5124" captured by the vehicle 14 includes a record in which the vehicle 14 passes through the position C, the position B, the position D, the position E, and the position F.

Examples of distribution and display of the image data will be described with reference to FIGS. 6 and 7.

Figure 6:
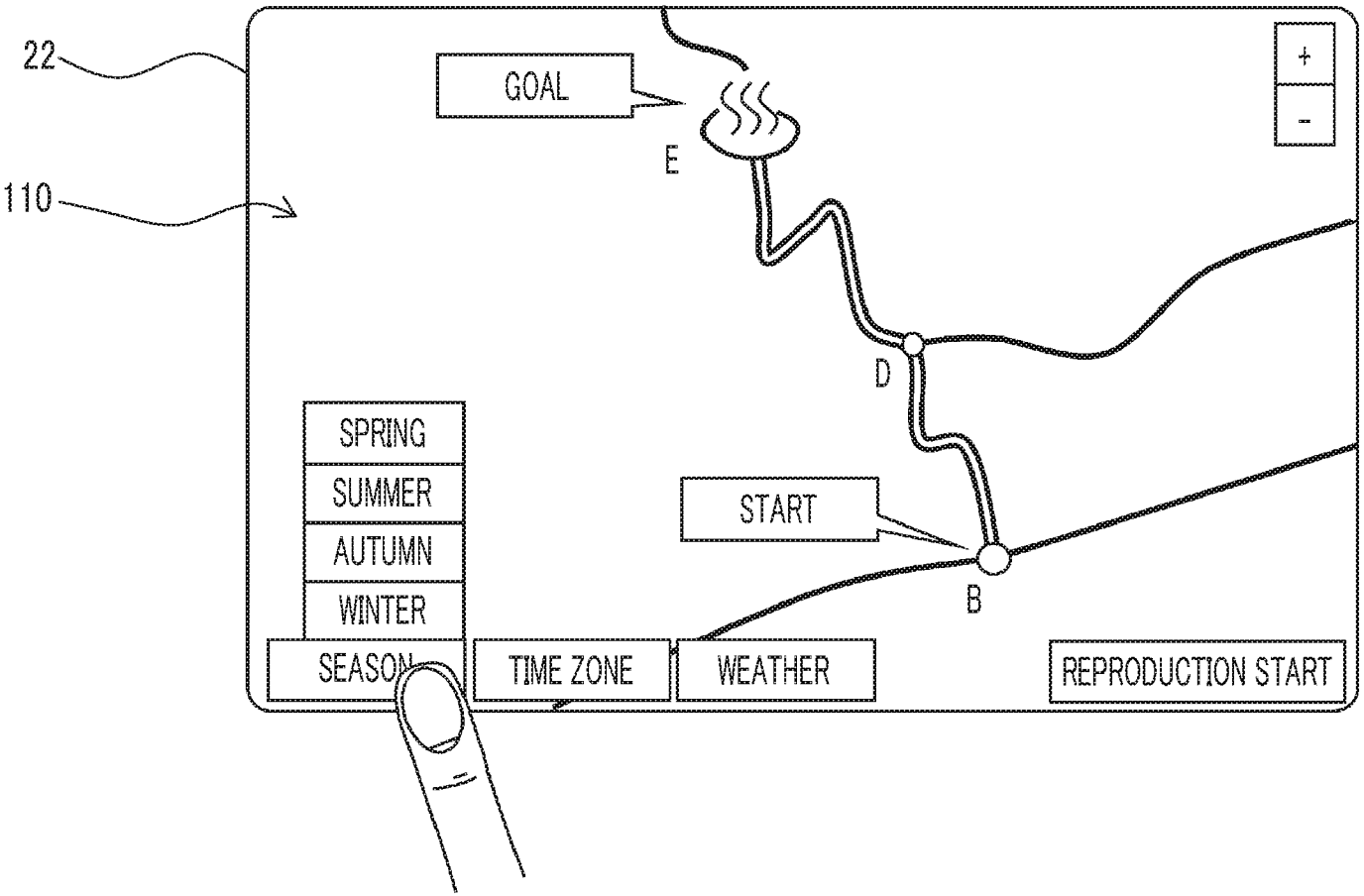
FIG. 6 is a diagram showing an example of a setting screen for image reproduction in conjunction with a car navigation system.

FIG. 6 shows an example of a screen of the car navigation system 110 displayed on the touch panel 22 of the vehicle 12. In the car navigation system 110, the user, such as a driver, performs operation, sets a start point (START) at the position B, and sets the goal point (GOAL) at the spa that is the position E. In the car navigation system 110, the route from the position B to the position E is indicated by a double line. The vehicle 12 can actually travel to the position E according to the guidance of the car navigation system 110.

In the example of FIG. 6, the user intends to display an image by operating the car navigation system 110. In the car navigation system 110, application programs for image distribution are integrated. The imaging position condition that the vehicle moves along the route of the road 102 from the position B to the position E is designated based on the operation of the car navigation system 110. In other words, the route setting mechanism in the car navigation system 110 is a designating unit that designates the imaging position condition.

On the screen of the car navigation system 110, the imaging environment condition can be designated. Specifically, buttons of "season", "time zone", and "weather" are set below the car navigation system 110. These buttons are an example of designating unit for designating the imaging environment condition.

In the example of FIG. 6, the user operates the button of "season". For this reason, sub-buttons of "spring", "summer", "autumn", and "winter" are newly displayed, and the user can select any season. In a case where the "time zone" button is operated, a time zone such as "6 to 9 o'clock", "9 to 12 o'clock", "12 to 15 o'clock" can be selected. By operating the "season" button and the "time zone" button, the user sets the imaging environment conditions relating to the imaging timing. In a case where the user does not operate the "season" button or the "time zone" button, for example, a setting value that is prepared in advance is adopted.

By operating the "weather" button, the user can select "clear", "cloudy", "rainy", or "snowy". The user sets the imaging environment condition relating to a weather condition at the time of imaging. In a case where the user does not operate the "weather" button, for example, a setting value that is prepared in advance is adopted.

In a case where the user operates a "reproduction start" button shown in FIG. 6, the vehicle 12 performs a distribution request to the distribution system 30. In this case, in the distribution server 60, the distribution request accepting unit 62 accepts a distribution request, and the image searching unit 64 searches the image data according to the set imaging position condition and the set imaging environment condition. Searching is performed by referring the table shown in FIG. 5. The image data having the data number "5030" or "5124" shown in FIG. 5 is selected. The image editing by the image editing unit 66 is performed as appropriate, and the distribution by the distribution unit 68 is performed. In the vehicle 12, receiving of the image data is performed (an example of a receiving unit).

Figure 7:
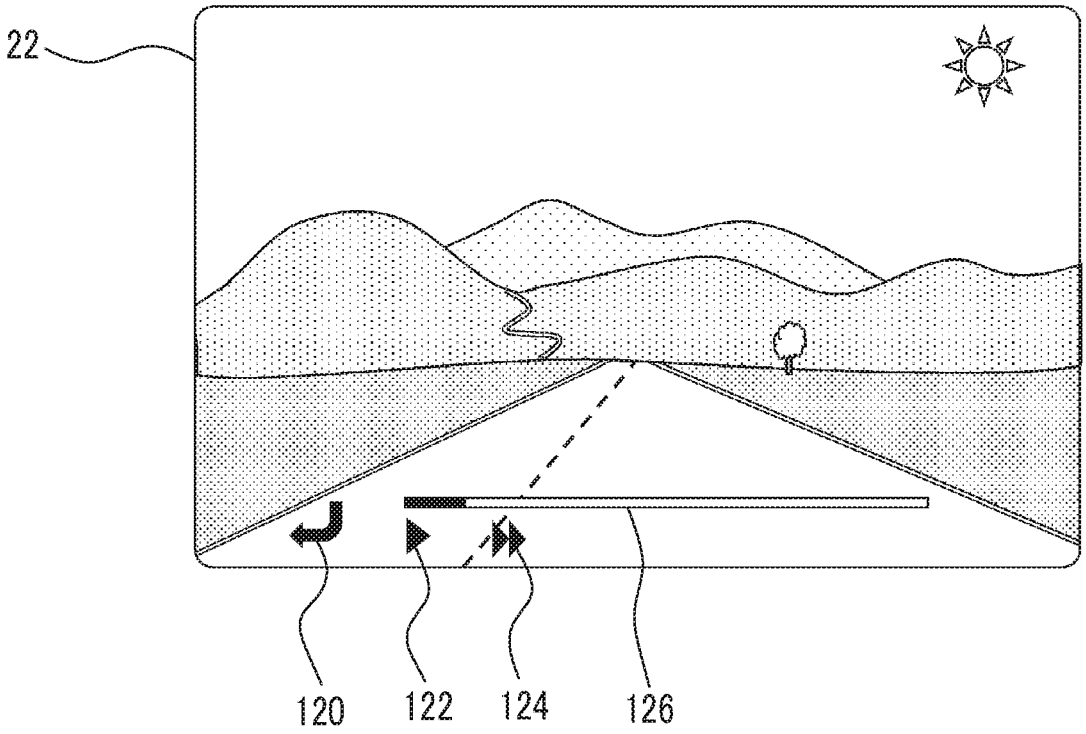
FIG. 7 is a diagram showing a display example of the image data.

FIG. 7 shows an example in which the distributed image data is displayed on the touch panel 22 of the vehicle 12 (an example of a display unit). On the touch panel 22, image data is displayed on the entire surface, and a return button 120, a reproduction button 122, a fast-forward button 124, and a reproduction bar 126 are displayed below. The return button 120 is a button for instructing to return to the screen of the car navigation system 110 shown in FIG. 6. The reproduction button 122 is a button for instructing whether to reproduce the image data at the normal speed or to pause. The fast-forward button 124 is a button for instructing fast-forward reproduction of image data. That is, the fast-forward button 124 is an instruction button for performing time reduction on the displayed image. The reproduction bar 126 is a display showing how much of the image data to be reproduced is currently reproduced with respect to the entire time. Reproduction from the corresponding time can be performed by touching the reproduction bar 126. The user can view the image data in a desired form by using these buttons.

The user can view the image data of the on-vehicle camera by designating the season or the weather, in addition to designation of the position. Therefore, the range of utilization of the image data is expanded, for example, the drive is simulated during a time when the autumn leaves are beautiful, or during a time when the night view is beautiful.

The distribution of the image data can be similarly requested from the smartphone 80 shown in FIG. 1, and can be displayed in the same manner. That is, in the on-vehicle camera image utilization system 10, a user who does not own the vehicles 12, 14 can also use the on-vehicle camera image utilization system 10.

In the above description, only the display aspect of the image data is described, but for example, audio output may be performed in accordance with the display of the image data. The output audio data may be recorded at the time of capturing the image data, or may be other data (sound effect or music). As an example, in a case where the winter season is selected as the imaging environment condition, outputting a sound effect or music related to the designated imaging environment condition, such as playing music with a winter theme, is conceivable.

In the example described above, the aspect in which the past image data is displayed according to the imaging position condition and the imaging environment condition is described. However, for example, the current image data can be displayed according to the imaging position condition.

The configuration of the on-vehicle camera image utilization system 10 described above is merely an example, and can be variously modified. For example, in the example shown in FIG. 3, the collection server 40 is provided with the individual data deleting processing unit 46 and the table creating unit 48. However, the individual data deleting processing unit 46 and the table creating unit 48 may be provided in the vehicles 12, 14. The on-vehicle camera image utilization system 10 need only be able to construct necessary functions as a whole system, and a degree of freedom is present in designing locations in which individual functions are provided.

What is claimed is:

1. An image data distribution system comprising a server configured to:

store image data captured by an on-vehicle camera in association with imaging position information indicating a position at which the image data was captured, and imaging environment information indicating a weather condition under which the image data was captured;

accept a distribution request indicating a start position, an end position, a route between the start position and the end position, and a specified weather condition;

search the image data to determine whether one or more images captured along the route between the start position and the end position under the specified weather condition are stored;

upon determination that one or more images captured along the route between the start position and the end position under the specified weather condition are stored, transmit the identified one or more images; and upon determination that one or more images captured along the route between the start position and the end position under the specified weather condition are not stored, combine a plurality of image data to generate a combined image along the route between the start position and the end position under the specified weather condition, and transmit the combined image.

2. The image data distribution system according to claim 1, wherein the distribution request indicates a condition relating to a timing at which imaging is performed.

3. The image data distribution system according to claim 2, wherein:

the distribution request indicates information on an event occurring around a vehicle equipped with the on-vehicle camera, and a condition for designating the event.

4. The image data distribution system according to claim 1, wherein the server is configured to perform editing for time reduction or time extension on the image data, wherein the server is configured to distribute the edited image data.

5. The image data distribution system according to claim 1, wherein the server is further configured to be communicable with a plurality of vehicles and configured to receive the image data captured by the on-vehicle camera of each vehicle, and wherein the server is configured to store the image data received by the server.

* * * * *